US007836897B2

(12) United States Patent
Borschke et al.

(10) Patent No.: US 7,836,897 B2
(45) Date of Patent: Nov. 23, 2010

(54) CIGARETTE HAVING CONFIGURED LIGHTING END

(75) Inventors: August Joseph Borschke, Winston-Salem, NC (US); Buddy Gene Brown, Durham, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 417 days.

(21) Appl. No.: 11/868,264

(22) Filed: Oct. 5, 2007

(65) Prior Publication Data

US 2009/0090373 A1 Apr. 9, 2009

(51) Int. Cl.
*A24C 1/26* (2006.01)

(52) U.S. Cl. ..... 131/361; 131/367

(58) Field of Classification Search ..... 131/361, 131/367

See application file for complete search history.

(56) References Cited

U.S. PATENT DOCUMENTS

| | | | |
|---|---|---|---|
| 2,004,394 | A | 6/1935 | Rowe |
| 2,180,370 | A | 11/1939 | Schallgruber |
| 2,874,700 | A | 2/1959 | Kahler |
| 3,251,367 | A | 5/1966 | Kuhl |
| 3,288,147 | A | 11/1966 | Mollins et al. |
| 3,308,600 | A | 3/1967 | Erdmann et al. |
| 3,396,733 | A | 8/1968 | Allseits et al. |
| 3,494,366 | A | 2/1970 | Starbuck et al. |
| 3,596,663 | A | 8/1971 | Schultz et al. |
| 3,915,176 | A | 10/1975 | Heitmann et al. |
| 4,174,719 | A | 11/1979 | Martin |
| 4,280,187 | A | 7/1981 | Reuland et al. |
| 4,281,670 | A | 8/1981 | Heitmann et al. |
| 4,281,671 | A | 8/1981 | Byrne et al. |

(Continued)

FOREIGN PATENT DOCUMENTS

| | | |
|---|---|---|
| FR | 986784 | 3/1949 |

(Continued)

OTHER PUBLICATIONS

Picture of a cigar tulip, retrieved from www.dopesmoke.com on Jun. 11, 2010 (NPL 1).*

(Continued)

*Primary Examiner*—Carlos Lopez
(74) *Attorney, Agent, or Firm*—Brinks Hofer Gilson & Lione

(57) ABSTRACT

The lighting end or tip of the smoking article is configured in such a manner that the entire front or upstream face thereof does not lie in a plane that is generally perpendicular to the longitudinal axis of the smoking article. For example, at least a portion of the front face of the smoking article lies in a plane (e.g., a generally flat plane) that is positioned about 40° to about 50° relative to the longitudinal axis of that smoking article. As such, the overall nature or character of the mainstream aerosol generated by a smoking article can be altered. This shape may include an ellipse, or may include a first section in a plane not perpendicular to the longitudinal axis and a second section in a plane perpendicular to the longitudinal axis. Alternatively, the face of the lighting end may have a shape such that its surface area is greater than the cross-sectional area of the smoking article.

19 Claims, 4 Drawing Sheets

U.S. PATENT DOCUMENTS

| | | | |
|---|---|---|---|
| 4,291,713 | A | 9/1981 | Frank |
| 4,474,190 | A | 10/1984 | Brand |
| 4,508,525 | A | 4/1985 | Berger |
| 4,574,816 | A | 3/1986 | Rudszinat |
| 4,637,410 | A | 1/1987 | Luke |
| 4,646,763 | A | 3/1987 | Nichols |
| 4,655,736 | A | 4/1987 | Keith |
| 4,726,385 | A | 2/1988 | Chumney, Jr. |
| 4,736,754 | A | 4/1988 | Heitmann et al. |
| 4,781,203 | A | 11/1988 | La Hue |
| 4,793,365 | A | 12/1988 | Sensabaugh, Jr. et al. |
| 4,807,809 | A | 2/1989 | Pryor et al. |
| 4,844,100 | A | 7/1989 | Holznagel |
| 4,850,301 | A | 7/1989 | Greene, Jr. et al. |
| 4,862,905 | A | 9/1989 | Green, Jr. et al. |
| 4,878,506 | A | 11/1989 | Pinck et al. |
| 4,920,990 | A | 5/1990 | Lawrence et al. |
| 5,012,823 | A | 5/1991 | Keritsis et al. |
| 5,012,829 | A | 5/1991 | Thesing et al. |
| 5,025,814 | A | 6/1991 | Raker |
| 5,060,664 | A | 10/1991 | Siems et al. |
| 5,060,665 | A | 10/1991 | Heitmann |
| 5,065,776 | A | 11/1991 | Lawson et al. |
| 5,074,320 | A | 12/1991 | Jones, Jr. et al. |
| 5,101,839 | A | 4/1992 | Jakob et al. |
| 5,105,838 | A | 4/1992 | White et al. |
| 5,156,169 | A | 10/1992 | Holmes et al. |
| 5,159,944 | A | 11/1992 | Arzonico et al. |
| 5,183,062 | A | 2/1993 | Clearman et al. |
| 5,191,906 | A | 3/1993 | Myracle, Jr. et al. |
| 5,220,930 | A | 6/1993 | Gentry |
| 5,271,419 | A | 12/1993 | Arzonico et al. |
| 5,360,023 | A | 11/1994 | Blakley et al. |
| 5,387,285 | A | 2/1995 | Rivers |
| 5,396,909 | A | 3/1995 | Gentry et al. |
| 5,551,451 | A | 9/1996 | Riggs et al. |
| 5,718,250 | A | 2/1998 | Banerjee et al. |
| 6,229,115 | B1 | 5/2001 | Vos et al. |
| 6,360,751 | B1 | 3/2002 | Fagg et al. |
| 6,537,186 | B1 | 3/2003 | Veluz |
| 6,647,870 | B2 | 11/2003 | Kohno |
| 6,708,695 | B2 | 3/2004 | Fagg et al. |
| 6,761,174 | B2 | 7/2004 | Jupe et al. |
| 6,779,530 | B2 | 8/2004 | Kraker |
| 6,848,449 | B2 | 2/2005 | Kitao et al. |
| 6,874,508 | B2 | 4/2005 | Shafer et al. |
| 6,904,917 | B2 | 6/2005 | Kintao et al. |
| 7,074,170 | B2 | 7/2006 | Lanier, Jr. et al. |
| 7,210,486 | B2 | 5/2007 | Hartmann |
| 7,234,471 | B2 | 6/2007 | Fitzgerald et al. |
| 7,237,559 | B2 | 7/2007 | Ashcraft et al. |
| 7,240,678 | B2 | 7/2007 | Crooks et al. |
| 7,275,548 | B2 | 10/2007 | Hancock et al. |
| 7,281,540 | B2 | 10/2007 | Barnes et al. |
| 2003/0136419 | A1 | 7/2003 | Muller |
| 2004/0261807 | A1 | 12/2004 | Dube et al. |
| 2005/0022829 | A1 | 2/2005 | Atwell et al. |
| 2005/0066986 | A1 | 3/2005 | Nestor et al. |
| 2005/0103355 | A1 | 5/2005 | Holmes |
| 2005/0194014 | A1 | 9/2005 | Read, Jr. |
| 2006/0169295 | A1 | 8/2006 | Draghetti |
| 2006/0272654 | A1 | 12/2006 | Barnes et al. |
| 2006/0272655 | A1 | 12/2006 | Thomas et al. |
| 2007/0006888 | A1 | 1/2007 | Hicks et al. |
| 2007/0023056 | A1 | 2/2007 | Cantrell et al. |
| 2007/0056600 | A1 | 3/2007 | Coleman, III et al. |
| 2007/0169786 | A1 | 7/2007 | Li et al. |
| 2007/0215167 | A1 | 9/2007 | Llewellyn Crooks et al. |
| 2007/0215168 | A1 | 9/2007 | Banerjee et al. |
| 2007/0246055 | A1 | 10/2007 | Oglesby |
| 2008/0245377 | A1 | 10/2008 | Marshall et al. |

FOREIGN PATENT DOCUMENTS

| | | |
|---|---|---|
| FR | 986784 | 8/1951 |
| WO | WO 03/009711 | 2/2003 |
| WO | WO 03/047836 | 6/2003 |
| WO | WO 2006/100605 | 9/2006 |
| WO | WO 2006/100605 A1 | 9/2006 |
| WO | WO 2006/064371 | 6/2008 |

OTHER PUBLICATIONS

Borschke et al., U.S. Appl. No. 11/868,264, titled *Cigarette Having Configured Lightning End*, filed Oct. 5, 2007, 41 pages.

* cited by examiner

CIGARETTE HAVING CONFIGURED LIGHTING END

BACKGROUND OF THE INVENTION

1. Field of the Invention

Aspects of the present invention are directed to smoking articles such as cigarettes and, more particularly, to cigarettes having configured lighting ends.

2. Description of Related Art

Popular smoking articles, such as cigarettes, have a substantially cylindrical rod shaped structure and include a charge, roll, or column of smokable material such as shredded tobacco (e.g., in cut filler form) surrounded by a paper wrapper thereby forming a so-called "smokable rod" or "tobacco rod." Normally, a cigarette has a cylindrical filter element aligned in an end-to-end relationship with the tobacco rod. Typically, a filter element comprises cellulose acetate tow plasticized using triacetin, and the tow is circumscribed by a paper material known as "plug wrap." A cigarette can incorporate a filter element having multiple segments, and one of those segments may include activated charcoal particles. See, for example, U.S. Pat. No. 6,537,186 to Veluz; PCT Pub. No. WO 2006/064371 to Banerjee; and U.S. Pat. App. Pub No. 2007/0056600 to Coleman III, et al.; each of which is incorporated herein by reference. Typically, the filter element is attached to one end of the tobacco rod using a circumscribing wrapping material known as "tipping paper," in order to provide a so-called "filtered cigarette." It also has become desirable to perforate the tipping material and plug wrap, in order to provide dilution of drawn mainstream smoke with ambient air. Descriptions of cigarettes and the various components thereof are set forth *Tobacco Production, Chemistry and Technology*, Davis et al. (Eds.) (1999) and U.S. patent application Ser. No. 11/696,416 to Marshall et al. Normally, a generally cylindrical or rod-shaped smoking article, such as a cigarette, has a generally circular cross-sectional shape, and each of the lighting tip and mouth end faces thereof extend virtually perpendicular to the longitudinal axis of that cigarette. A cigarette typically is employed by a smoker by lighting one end thereof and burning the tobacco rod. The smoker then receives mainstream aerosol (e.g., smoke) into his/her mouth by drawing on the opposite end (e.g., the filter or mouth end) of the cigarette.

Various attempts to alter the visual attributes of cigarettes have been proposed. For example, there have been attempts to alter the color of the wrapping materials that provide the wrapping material of the tobacco rod (e.g., cigarettes marketed under the trade name "More" by R. J. Reynolds Tobacco Company possess cigarette rod wrapping papers exhibiting a brown color) and tipping materials used to attach the tobacco rod to the filter element (e.g., tipping materials have been printed or otherwise formed so as to possess a "cork" appearance and/or to possess at least one circumscribing ring). In addition, there have been attempts to alter the general appearance of the filter elements of cigarettes. See, for example, the types of cigarette filter element formats, configurations and designs set forth in U.S. Pat. No. 3,396,733 to Allseits et al.; U.S. Pat. No. 3,596,663 to Schultz; U.S. Pat. No. 4,281,671 to Byrne; U.S. Pat. No. 4,508,525 to Berger; U.S. Pat. No. 4,637,410 to Luke; U.S. Pat. No. 4,646,763 to Nichols; U.S. Pat. No. 4,655,736 to Keith; U.S. Pat. No. 4,726,385 to Chumney, Jr.; U.S. Pat. No. 4,807,809 to Pryor et al.; and U.S. Pat. No. 5,025,814 to Raker; and U.S. Patent Application Publication Nos. 2007/0023056 to Cantrell et al. and 2007/0169786 to Li et al.; each of which is incorporated herein by reference.

Certain attempts have been made to alter the nature or character of smoke generated by cigarettes through the positioning of various components or component materials near the lighting ends or tip portions of cigarettes. In one regard, a cigarette having a paper wrapped tobacco rod may include ingredients (e.g., ammonium salts or tobaccos having relatively high ammonia levels) located at its tip portion that corresponds to its lighting end. See, for example, U.S. Pat. No. 6,874,508 to Shafer et al. and U.S. Patent Application Publication No. 2005/0022829 to Atwell et al., which are incorporated herein by reference. Likewise, attempts have been made to alter the nature or character of smoke by positioning components near the mouth end of cigarettes. See, for example, U.S. Pat. No. 3,494,366 to Starbuck et al., entitled, "Cigarette Having Heat Sink Means For Removing Impurities From Cigarette Smoke."

In yet another regard, certain types of cigarettes, such as those marketed commercially under the brand names "Premier" and "Eclipse" by R. J. Reynolds Tobacco Company, have incorporated combustible fuel sources (e.g., carbonaceous fuel elements) that generate heat for the production of a smoke-like aerosol. See, for example, the types of smoking articles set forth in U.S. Pat. No. 4,793,365 to Sensabaugh et al.; U.S. Pat. No. 5,183,062 to Clearman et al.; and U.S. Pat. No. 5,551,451 to Riggs et al.; and U.S. Patent Application Publication Nos. 2007/0023056 to Cantrell et al.; 2007/0215167 to Crooks et al; and 2007/0215168 to Banerjee et al.; each of which is incorporated herein by reference.

It would be desirable to provide a manner or method for providing alteration of the overall composition of mainstream aerosol generated by a cigarette.

BRIEF SUMMARY OF THE INVENTION

The present invention relates to smoking articles, and in particular, to generally rod-shaped smoking articles, such as cigarettes. Each smoking article comprises a lighting end or tip (i.e., an upstream end), and a mouth end (i.e., a downstream end). In one regard, the smoking article may include an aerosol-generating system that includes (i) a heat generation segment (e.g., a short heat source comprising a combustible material, such as a carbonaceous material) located at the upstream end, and (ii) an aerosol-generating region or segment located downstream from the heat generation segment. In another regard, the smoking article may include smokable material (e.g., a roll of tobacco in cut filler form) wrapped in a circumscribing paper wrapper, thereby forming a tobacco rod. The lighting end or tip of the smoking article is configured in such a manner that the entire front or upstream face thereof does not lie in a plane that is generally perpendicular to the longitudinal axis of the smoking article. For example, for a cylindrically-shaped smoking article rod having a generally circular cross-sectional shape, the upstream face (i.e., the front face) of the smoking article can resemble an ellipse in general appearance, and not resemble a circle, when viewed at an angle generally perpendicular to the nominal plane of the front face. In one embodiment for example, the front face (i.e, exposed end surface) of the lighting end of the smoking article may lie along a front plane (e.g., a generally flat plane, such as can be provided by slicing or otherwise forming the lighting end of the smoking article in an essentially straight line) that is positioned at least about 30°, and often at least about 40° relative to the longitudinal axis of that smoking article; and up to about 70°, and often up to about 60° relative to the longitudinal axis of the smoking article. Alternatively, the front face of the smoking article may lie along a somewhat curved plane (e.g., in a parabolic-type configuration, in a convex or concave manner, where the side profile of the front face is a part of a parabolic-type contour), wherein the somewhat curved front face nominally lies along a front plane that is at least about 30°, and often at least about 40° relative to the longitudinal axis of that smoking article; and up to about 70°, and often up to about 60° relative to the longitudinal axis of the smoking article. For certain embodiments, the front face can be configured so as to possess a relatively flat form and appearance; however, if desired the front face can be configured so as to have a somewhat rough or what might be characterized as a serrated appearance.

In another aspect, the present invention relates to a manner or method for altering the overall nature or character of the mainstream aerosol generated by a smoking article. As such, the chemical nature of mainstream aerosol generated by a smoking article can be altered by providing a lighting end or tip that does not entirely lie in a plane that is generally perpendicular to the longitudinal axis of that smoking article.

Aspects of the present invention thus address the needs identified above and provide significant advantages as further discussed herein.

BRIEF DESCRIPTION OF THE SEVERAL VIEWS OF THE DRAWINGS

Figure 1:
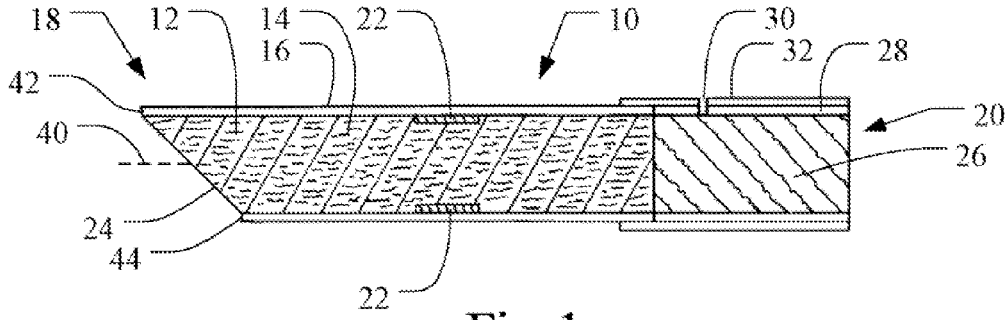

Having thus described the invention in general terms, reference will now be made to the accompanying drawings, which are not necessarily drawn to scale, and wherein:

FIG. 1 is a longitudinal cross-sectional view of one embodiment of a smoking article representative of the present invention.

Figure 2:
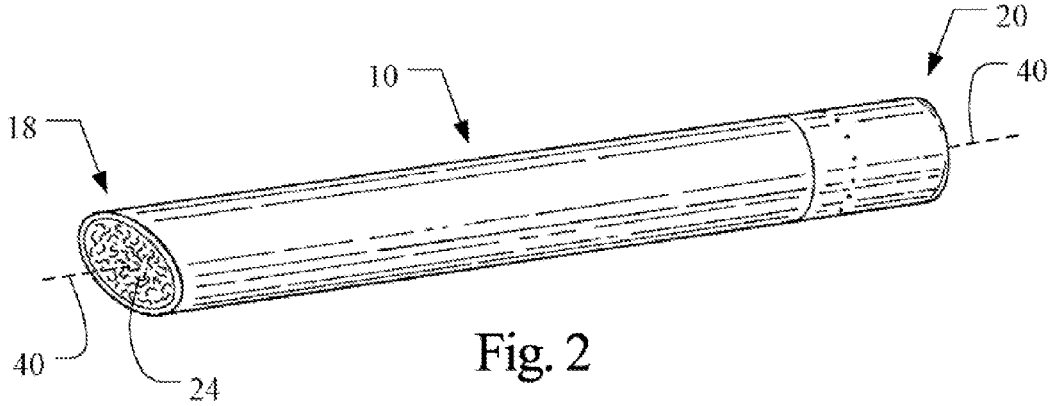

FIG. 2 is a perspective view of a smoking article of the type shown in FIG. 1.

FIGS. 3 through 7 are longitudinal cross-sectional views of several embodiments of smoking articles representative of the present invention.

Figure 8:
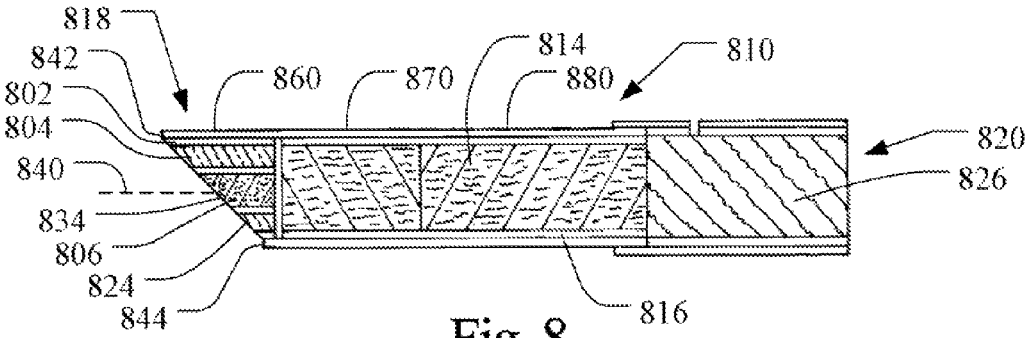

FIG. 8 is a longitudinal cross-sectional view of another embodiment of a smoking article representative of the present invention.

Figure 9:
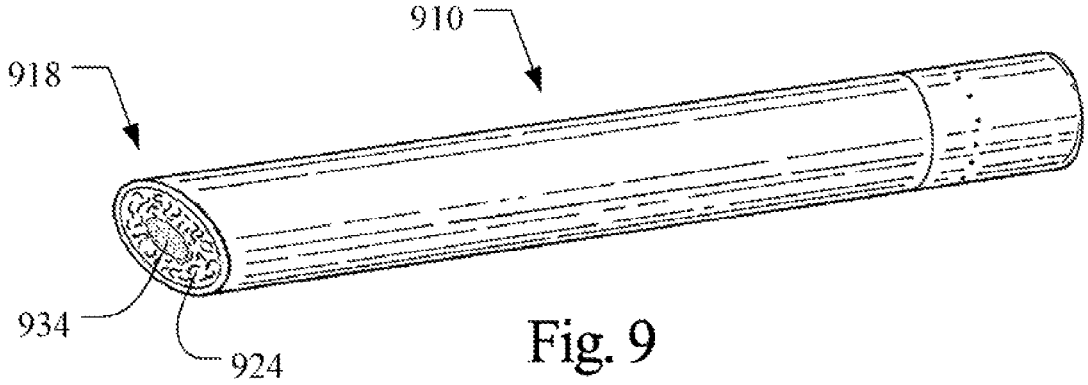

FIG. 9 is a perspective view of a smoking article of the type shown in FIG. 8.

FIGS. 10 through 15 are longitudinal cross-sectional views of several embodiments of smoking articles representative of the present invention.

DETAILED DESCRIPTION OF THE INVENTION

The present invention now will be described more fully hereinafter with reference to the accompanying drawings, in which some, but not all aspects of the invention are shown. Indeed, the present invention may be embodied in many different forms and should not be construed as limited to the aspects set forth herein; rather, these aspects are provided so that this disclosure will satisfy applicable legal requirements. Like numbers refer to like elements throughout.

Referring to FIG. 1, there is shown a smoking article 10 in the form of a cigarette and possessing certain representative components of a smoking article of the present invention. The cigarette 10 includes a generally cylindrical rod 12 of a charge or roll of smokable filler material 14 contained in a circumscribing wrapping material 16. The rod 12 is conventionally referred to as a "tobacco rod." Typical tobacco rods have maximum lengths of about 45 mm to about 85 mm, often about 50 mm to about 80 mm, and frequently about 55 mm to about 75 mm. The ends of the tobacco rod 12 are open to expose the smokable filler material. The cigarette 10 is shown as having one optional band 22 (e.g., a printed coating including a film-forming agent, such as starch, ethylcellulose, or sodium alginate) applied to the wrapping material 16, and that band circumscribes the cigarette rod in a direction transverse to the longitudinal axis of the cigarette. That is, the band 22 provides a cross-directional region relative to the longitudinal axis of the cigarette. The band 22 can be printed on the inner surface of the wrapping material 16 (i.e., facing the smokable filler material), or less preferably, on the outer surface of the wrapping material. Although the cigarette can possess a wrapping material having one optional band, the cigarette also can possess wrapping material having further optional spaced bands numbering two, three, or more.

At one end of the tobacco rod 12 is the lighting end 18, and at the mouth end 20 is positioned a filter element 26. The filter element 26 is positioned adjacent one end of the tobacco rod 12 such that the filter element and tobacco rod are axially aligned in an end-to-end relationship, preferably abutting one another. Filter element 26 may have a generally cylindrical shape, and the diameter thereof may be essentially equal to the diameter of the tobacco rod. The ends of the filter element 26 permit the passage of air and smoke therethrough. The filter element 26 is circumscribed along its outer circumference or longitudinal periphery by a layer of outer plug wrap 28.

A ventilated or air diluted smoking article can be provided with an optional air dilution means, such as a series of perforations 30, each of which extend through the outer tipping material 32 and inner plug wrap 28. The optional perforations 30 can be made by various techniques known to those of ordinary skill in the art, such as laser perforation techniques. Alternatively, so-called off-line air dilution techniques can be used (e.g., through the use of porous paper plug wrap and pre-perforated tipping paper). For cigarettes that are air diluted or ventilated, the amount or degree of air dilution or ventilation can vary. Frequently, the amount of air dilution for an air diluted cigarette is greater than about 10 percent, generally is greater than about 20 percent, often is greater than about 30 percent, and sometimes is greater than about 40 percent. Typically, the upper level for air dilution for an air diluted cigarette is less than about 80 percent, and often is less than about 70 percent. As used herein, the term "air dilution" is the ratio (expressed as a percentage) of the volume of air drawn through the air dilution means to the total volume and air and smoke drawn through the cigarette and exiting the extreme mouth end portion of the cigarette.

At the lighting end 18, the tobacco rod 12 has an extreme upstream face 24 (also referred to as front face) that forms a plane that entirely lies at an angle relative to the longitudinal axis 40 of the cigarette. That is, no portion of the upstream face lies on a plane that is essentially perpendicular to the longitudinal axis of the cigarette. Typically, the front face of the tobacco rod lies along a front plane (e.g., a generally flat plane, such as can be provided by slicing or otherwise forming the lighting end of the cigarette in an essentially straight line) that is positioned at least about 30°, and often at least about 40° relative to the longitudinal axis of that cigarette; and up to about 70°, and often up to about 60° relative to the longitudinal axis of the cigarette. For example, the front face of the tobacco rod lies along a front plane that is positioned at an angle of about 40° to about 50° relative to the longitudinal axis of the cigarette; as opposed to an angle of about 90° for a traditional type of cigarette.

Alternatively, the upstream face 24 may have a planar configuration such that for a generally cylindrical tobacco rod having a circumference of about 17 mm to about 27 mm, most preferably about 22 mm to about 25 mm, one extreme tip 42 of the wrapping material extends at least about 5 mm, often at least about 7 mm beyond the opposite extreme tip 44 of that wrapping material on the opposite side (i.e., spaced 180°) of the front face of that tobacco rod optionally, the extreme tip 42 of the wrapping material extends up to about 15 mm, often up to about 13 mm beyond the opposite extreme tip 44 of that wrapping material on the opposite side of that tobacco rod; as opposed to essentially no difference in length of the opposite extreme tips for the wrapping material of a traditional cigarette with a front face perpendicular to the longitudinal axis of the cigarette.

Referring to FIG. 2, there is shown a perspective view of a cigarette 10 that is similar in many regards to the cigarette shown in FIG. 1, having both a lighting end 18 and mouth end 20. The lighting end 18 of the cigarette is shown having an upstream face 24 in a plane that is not perpendicular to the longitudinal axis 40 of the cigarette. As such, for a cylindrical tobacco rod having a generally circular cross-sectional shape, the exposed face 24, or the lighting face, of that tobacco rod appears to have a shape that, when viewed perpendicularly to the plane of the front face, is generally elliptical in nature; as opposed to a generally circular shaped exposed end for a traditional cigarette.

Figure 3:
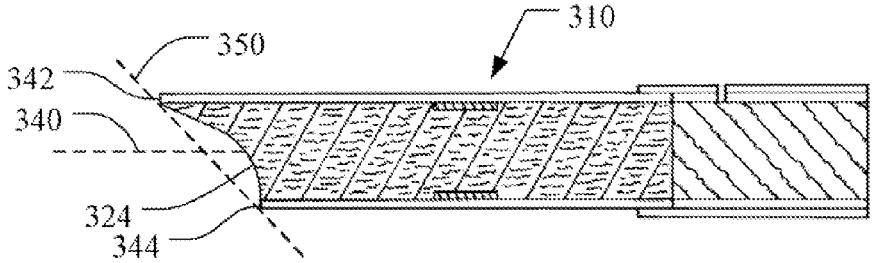

Referring to FIG. 3, there is shown a cigarette 310 that is similar in many regards to the cigarette 10 shown in FIG. 1. However, rather than forming an essentially flat plane, the front face 324 of the cigarette is somewhat curved in nature (e.g., in a manner that might be characterized as somewhat parabolic or otherwise non-linear in nature). As shown, the entire front face 324 of the cigarette rod is curved in towards the rod in a fashion that can be characterized as somewhat concave in nature. The front face 324 of the cigarette is configured nominally along a plane 350 (such as the plane extending between the longest extreme tip 342 and the opposite shortest extreme tip 344 of the cigarette) at least about 30°, and often at least about 40° relative to the longitudinal axis 340 of that cigarette; and up to about 70°, and often up to about 60° relative to the longitudinal axis 340 of the cigarette. For example, the front face 324 of the tobacco rod lies along a front plane that nominally is positioned at an angle of about 40° to about 50° relative to the longitudinal axis of the cigarette; as opposed to an angle of about 90° for a traditional type of cigarette.

Alternatively, the upstream face 324 may have a concavely curved configuration such that, for example, for a generally cylindrical tobacco rod having a circumference of about 17 mm to about 27 mm, most preferably about 22 mm to about 25 mm, one extreme tip 342 of the wrapping material extends at least about 5 mm, often at least about 7 mm beyond the opposite extreme tip 344 of that wrapping material on the opposite side (i.e., spaced 180°) of the front face of that tobacco rod, while the extreme tip of the wrapping material extends up to about 15 mm, often up to about 13 mm beyond the opposite extreme tip of that wrapping material on the opposite side of the front face of that tobacco rod; as opposed to essentially no difference for the wrapping material extreme tips of a traditional cigarette. As such, for a cylindrical tobacco rod having a generally circular cross-sectional shape, the exposed end, or the lighting face, of that tobacco rod appears to have a shape that, when viewed perpendicularly end on to the nominal plane 350, is generally elliptical in nature; as opposed to a generally circular shaped exposed end for a traditional cigarette.

Figure 4:
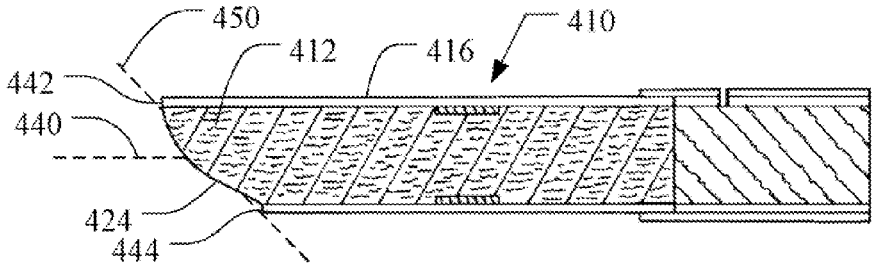

Referring to FIG. 4, there is shown a cigarette 410 that is similar in many regards to the cigarette 310 shown in FIG. 3. However, for the embodiment shown in FIG. 4, the entire front face 424 of the tobacco rod 412 can be curved outwards from the rod in a fashion that can be characterized as somewhat convex in nature. In other words, the front face 424 has a convexly curved surface that extends outwardly beyond the nominal plane lying between the longest extreme tip 442 of the wrapping material 416 and the opposite shortest extreme tip 444 of the wrapping material, where the nominal plane is not perpendicular to the longitudinal axis of the cigarette 410. Preferably the nominal plane 450 is at least 30°, or at least 40° from the longitudinal axis 440 of the cigarette and not more than 70°, not more than 60° or not more than 50° from the longitudinal axis 440 of the cigarette.

Figure 5:
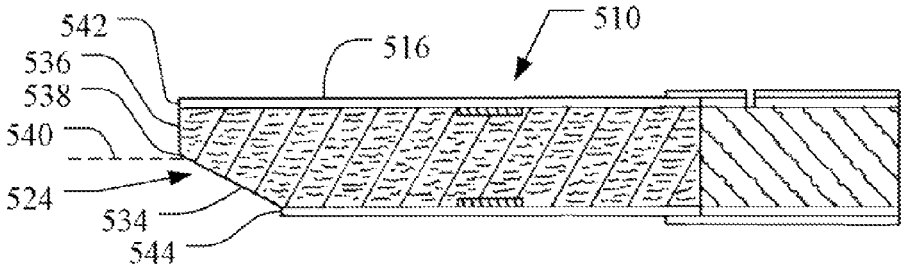

Referring to FIG. 5, there is shown a cigarette 510 that is similar in many regards to the cigarette 10 shown in FIG. 1. However, rather than the entire front face of the cigarette forming a plane that is not perpendicular to the longitudinal axis of the cigarette, a portion 536 of the front face 524 of the cigarette lies in a plane that is virtually perpendicular to the longitudinal axis 540 of the cigarette and a portion 534 of the front face 524 of the cigarette lies in a plane that is not perpendicular to the longitudinal axis 540 of the cigarette. Preferably the non-perpendicular portion 534 is contiguous with the perpendicular portion 536. However, the two portions 534 and 536 may join at a border region 538. The border region 538 may variously comprise a sharp edge (as shown), a generally curved surface, or a generally planar surface. Most preferably, the exposed surface area of the front face portion 534 of the cigarette that forms a plane generally perpendicular to the longitudinal axis of the cigarette is less than the exposed surface area of the front face portion 524 that forms a plane that is not perpendicular (or angled) relative to the longitudinal axis of the cigarette. The angled front face 534 of the cigarette is configured nominally in a plane at least about 30°, and often at least about 40° relative to the longitudinal axis of that cigarette; and up to about 70°, and often up to about 60° relative to the longitudinal axis 540 of the cigarette. For example, a portion 534 of the front face 524 of the tobacco rod lies along a front plane that nominally is positioned at an angle of about 40° to about 50° relative to the longitudinal axis 540 of the cigarette; as opposed to an angle of about 90° for the other front face portion 536 of that cigarette.

Alternatively, the upstream face 524 may have a multi-planar or multi-faceted configuration such that, for example, for a generally cylindrical tobacco rod having a circumference of about 17 mm to about 27 mm, most preferably about 22 mm to about 25 mm, one extreme tip 542 of the wrapping material 516 extends at least about 3 mm, often at least about 5 mm, beyond the opposite extreme tip 544 of that wrapping material on the opposite side (i.e., spaced 180°) of the front face 524 of that tobacco rod. Preferably, the extreme tip 542 of the wrapping material typically extends no more than about 15 mm, often no more than about 10 mm, beyond the opposite extreme tip 544 of that wrapping material on the opposite side of the front face 524 of that tobacco rod. As such, for a cylindrical tobacco rod having a generally circular cross-sectional shape, the exposed end, or the lighting face 524, of that tobacco rod appears to have a shape, when viewed end on, that is partially generally circular in nature and partially generally elliptical in nature. Preferably, when viewed end on perpendicularly to the plane formed from the angled front face 534, the exposed end 524 appears composed of two sections of differently shaped ellipses.

Figure 6:
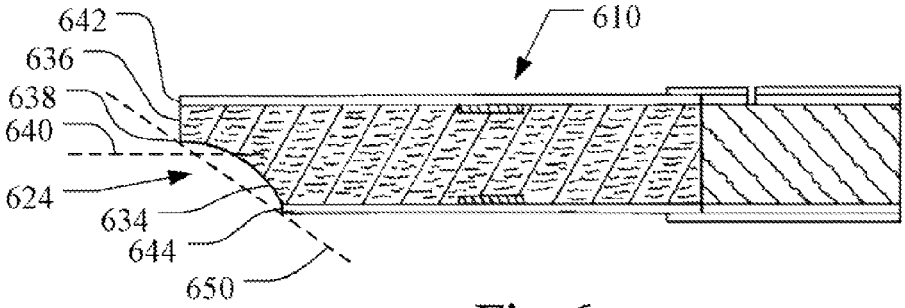

Referring to FIG. 6, there is shown a cigarette 610 that is similar in many regards to the cigarette 510 shown in FIG. 5. However, the angled face 634, rather than forming an essentially flat plane, is somewhat curved in nature. As shown, a portion 636 of the front face 624 is perpendicular to the longitudinal axis of the cigarette and a portion 634 of front face 624 of the cigarette rod is curved in towards the rod in a fashion that can be characterized as somewhat concave in nature. Alternatively, for an embodiment not shown, that curved portion of the front face of the cigarette rod can be curved outwards from the rod in a fashion that can be characterized as somewhat convex in nature. Preferably the non-perpendicular portion 634 is contiguous with the perpendicular portion 636. However, the two portions 634 and 636 may join at a border region 638. The border region 638 may variously comprise a sharp edge (as shown), a generally curved surface, or a generally planar surface. Most preferably, the exposed area of the front face portion 636 of the cigarette that forms a plane generally perpendicular to the longitudinal axis 640 of the cigarette is less than the exposed area of the front face portion 634 that lies along a nominal plane that is not perpendicular (or angled) relative to the longitudinal axis 640 of the cigarette. The nominal plane 650 is that plane defined by (1) the shortest extreme tip 644 of the wrapping material, and (2) either the junction between the curved portion 634 of the front face 624 and the perpendicular portion 636 of the front face, or where no junction is readily discernable or present, then at the edge of the curved face portion 634 farthest from the shortest extreme tip. The angled front face 634 of the cigarette is configured nominally along a plane 650 positioned at least about 30°, and often at least about 40° relative to the longitudinal axis of that cigarette; and up to about 70°, and often up to about 60° relative to the longitudinal axis 640 of the cigarette. For example, the curved portion 634 of the front face of the tobacco rod lies along a plane that nominally is positioned at an angle of about 40° to about 50° relative to the longitudinal axis of the cigarette; as opposed to an angle of about 90° for the other front face portion 636 of that cigarette.

Alternatively, the upstream face 624 may have a multi-surfaced configuration lying nominally along multiple different planes such that, for example, for a generally cylindrical tobacco rod having a circumference of about 17 mm to about 27 mm, most preferably about 22 mm to about 25 mm, one extreme tip 642 of the wrapping material extends at least about 3 mm, often at least about 5 mm beyond the opposite extreme tip 644 of that wrapping material on the opposite side (i.e., spaced 180°) of the front face 624 of that tobacco rod. Preferably, the extreme tip 642 of the wrapping material extends not more than about 15 mm, often not more than about 10 mm, beyond the opposite extreme tip 644 of that wrapping material on the opposite side of the front face 624 of that tobacco rod. As such, for a cylindrical tobacco rod having a generally circular cross-sectional shape, the exposed end, or the lighting face, of that tobacco rod appears to have a shape, when viewed end on, that is partially generally circular in nature and partially generally elliptical in nature. Preferably, when viewed end on perpendicularly to the nominal plane along which lies the curved front face portion 634, the exposed end 624 appears composed of two sections of differently shaped ellipses that may be irregularly shaped depending on the relative curvature of the front face portion 634.

Figure 7:
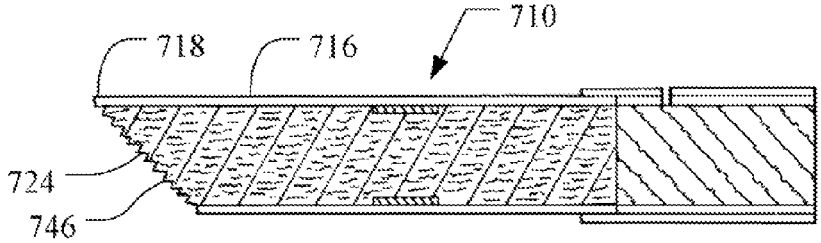

Referring to FIG. 7, there is shown a cigarette 710 that is similar in many regards to the cigarette 10 shown in FIG. 1. However, for the embodiment shown in FIG. 7, the angled front face 724 can be configured so as to possess a somewhat rough, jagged or serrated appearance, as opposed to a relatively flat form and appearance. For example, the extreme lighting end 718 of the wrapping material 716 can have, rather than a smooth or straight cut appearance, an appearance at an edge 746 when viewed cross-wise resembling that of a saw-toothed blade, a square wave, a scalloped-type or wavy-type of appearance, a shredded-type of appearance, or other type of roughened or serrated type of appearance. If desired, the various embodiments described with reference to FIGS. 3 through 6 also can be configured so as to possess a somewhat rough or serrated type of appearance at the extreme lighting end.

Alternatively, instead of cigarettes with tobacco rods composed entirely of smokable tobacco cut filler, cigarettes of the type set forth U.S. Patent Application Publication Nos. 2007/0023056 to Cantrell et al. can have smokable lighting end segments that are modified in the manner set forth hereinbefore with reference to FIG. 1 through 7.

In use, cigarettes of the type described with reference to FIGS. 1 through 7, can be used in the following manner. Typically, the smoker lights the lighting end of the cigarette using a match or flame-type cigarette lighter, for example, using the types of technique set forth in U.S. Pat. No. 6,874,508 to Shafer et al. Alternatively, the cigarette can be lighted using an electric resistance element type of heating device, such as an automobile cigarette lighter. If desired, the cigarette can be positioned relative to the flame of match or cigarette lighter so that the exposed smokable material of lighting end of the tobacco rod faces the flame. Alternatively, if desired, the cigarette can be positioned relative to the flame of match or cigarette lighter so that the exposed smokable material of lighting end of the tobacco rod does not face the flame, but rather, the wrapping material of the tobacco rod near the lighting end of the cigarette faces the flame. If desired, the exposed smokable material of the lighting end of the tobacco rod can be positioned during lighting to face downwards, upwards, or to one side; and in each such situation, the tip of the flame of the match or cigarette lighter can be positioned slightly below the extreme lighting end. After being lit, the cigarette can be smoked in an essentially normal fashion.

Referring to FIG. 8, a representative smoking article 810 in the form of a cigarette is shown in a longitudinal cross-sectional view. That representative cigarette 810 includes a heat generation segment 860 located at the lighting end 818, a filter segment 826 located at the mouth end 820, an aerosol-formation segment 870 located adjacent to the heat generation segment, and tobacco-containing segment 880 located adjacent to the filter segment 826. If desired, the tobacco-containing segment 880 can be a multi-component segment that has been combined to form a single component piece. The compositions, formats, arrangements and dimensions of the various segments of the smoking article 810 can be generally similar to those incorporated within those cigarettes commercially marketed under the trade name "Eclipse" by R. J. Reynolds Tobacco Company. The tobacco-containing segment 155 may include tobacco and/or tobacco flavor generating material 814 (e.g., tobacco cut filler, processed tobacco cut filler, strips of tobacco material, a gathered web of reconstituted tobacco material, or the like). That segment can possess a circumscribing wrapper 816, such as a paper wrapping material. See, also, those types of cigarette formats, configurations and components set forth in U.S. Patent Application Publication No. 2007/0215167 to Crooks et al.

At the lighting end 818, the cigarette 810 can possess at least one outer layer of wrapping material 802 that overlies an insulation region 804, that in turn overlies a fuel element 806 (e.g., a carbonaceous, combustible fuel element). See, for example, the types of fuel element and lighting end components and configurations set forth in U.S. Pat. No. 5,065,776 to Lawson et al. and U.S. Patent Application Publication No. 2007/0215167 to Crooks et al. Typically, a representative lighting end region 818 has a length of at least about 10 mm, and often at least about 15 mm, but less than about 30 mm, often less than about 25 mm, frequently less than about 20 mm. The fuel element 806 has an extreme upstream face 834 that forms a plane that lies at an angle relative to the longitudinal axis 840 of the cigarette 810. That is, no portion of the upstream face of the cigarette lies on a plane that is essentially perpendicular to the longitudinal axis of the cigarette. Typically, the front face 824 of the tobacco rod lies along a front plane (e.g., a generally flat plane, such as can be provided by slicing or otherwise forming the lighting region of the cigarette in an essentially straight line) that is positioned at least about 30°, and often at least about 40° relative to the longitudinal axis 840 of that cigarette; and up to about 70°, and often up to about 60° relative to the longitudinal axis of the cigarette. For example, the front face 824 of the tobacco rod lies along a front plane that is positioned at an angle of about 40° to about 50° relative to the longitudinal axis of the cigarette.

Alternatively, the front face 824 may have a planar configuration such that for a generally cylindrical cigarette having a circumference of about 22 mm to about 25 mm, one extreme tip 842 of the wrapping material 816 extends at least about 5 mm, often at least about 7 mm beyond the opposite extreme tip 844 of that wrapping material on the opposite side (i.e., spaced 180°) of the front face 824 of that cigarette rod. Preferably, the extreme tip 842 of the wrapping material extends not more than about 15 mm, often not more than about 13 mm, beyond the opposite extreme tip 844 of that wrapping material on the opposite side of the front face of that cigarette rod. As such, for a cylindrical tobacco rod having a generally circular cross-sectional shape, the exposed end, or the lighting face, of that cigarette rod (i.e., as provided, for example, by wrapping materials, insulation and formed fuel element) appears to have a shape that, when viewed perpendicularly to the front face, is generally elliptical in nature.

Referring to FIG. 9, there is shown in perspective view a cigarette 910 that is similar in many regards to the cigarette 810 shown in FIG. 8. The angled lighting end 918 of the cigarette is shown. As such, for a cylindrical tobacco rod having a generally circular cross-sectional shape, the exposed end 924, and particularly the exposed end 934 of the fuel element, of that tobacco rod appears to have a shape that, when viewed perpendicularly to the plane of the front face 924, is generally elliptical in nature; as opposed to a generally circular shaped exposed end for a traditional cigarette.

Figure 10:
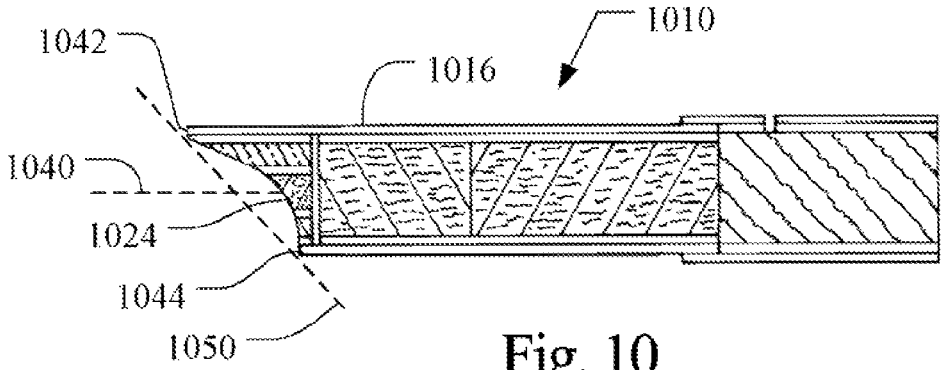

Referring to FIG. 10, there is shown a cigarette 1010 that is similar in many regards to the cigarette 910 shown in FIG. 8. However, rather than forming an essentially flat plane, the front face 1024 of the cigarette 1010 is somewhat curved in nature. As shown in FIG. 10, the entire front face 1024 of the cigarette rod 1010 is curved in towards the rod in a fashion that can be characterized as somewhat concave in nature. The front face 1024 of the cigarette is configured nominally along a plane 1050 at a position at least about 30°, and often at least about 40° relative to the longitudinal axis 1040 of that cigarette; and up to about 70°, and often up to about 60° relative to the longitudinal axis of the cigarette. For example, the front face 1024 of the cigarette rod lies along a front plane 1050 that nominally is positioned at an angle of about 40° to about 50° relative to the longitudinal axis 1040 of the cigarette.

Alternatively, the upstream face 1024 may have a concavely curved configuration such that, for example, for a generally cylindrical cigarette rod having a circumference of about 22 mm to about 25 mm, one extreme tip 1042 of the wrapping material 1016 extends at least about 7 mm beyond the opposite extreme tip 1044 of that wrapping material on the opposite side (i.e., spaced 180°) of the upstream face 1024 of that cigarette rod. Preferably, the extreme tip 1042 of the wrapping material extends up to about 15 mm, often up to about 13 mm beyond the opposite extreme tip 1044 of that wrapping material on the opposite side of the front face 1024 of that rod. As such, for a cylindrical cigarette rod having a generally circular cross-sectional shape, the exposed end, or the lighting face, of that rod appears to have a shape that, when viewed perpendicularly end on that nominal plane, appears generally elliptical in nature; as opposed to a generally circular shaped exposed end.

Figure 11:
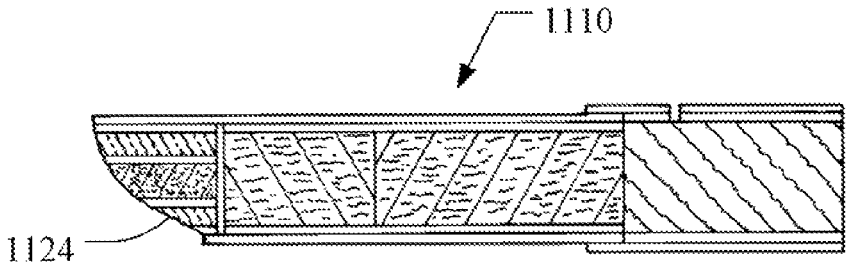

Referring to FIG. 11, there is shown a cigarette 1110 that is similar in many regards to the cigarette 1010 shown in FIG. 10. However, for that embodiment, the entire front face 1124 of the cigarette rod can be curved outwards from the rod in a fashion that can be characterized as somewhat convex in nature.

Figure 12:
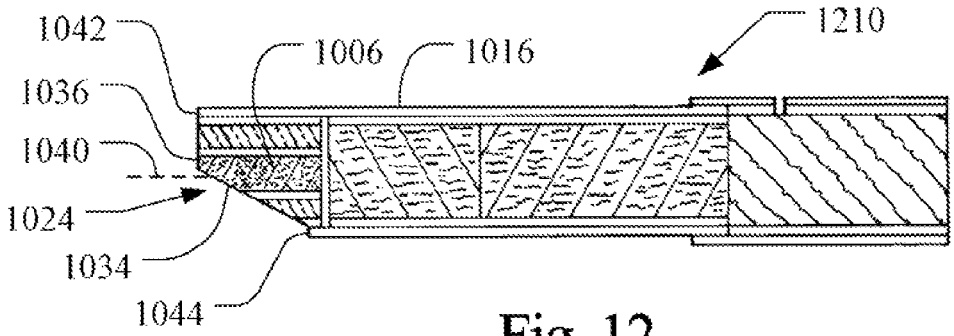

Referring to FIG. 12, there is shown a cigarette 1210 that is similar in many regards to the cigarette 810 shown in FIG. 8. However, rather than the entire front face of the cigarette forming a plane that is not perpendicular to the longitudinal axis of the cigarette, a portion 1036 of the front face 1024 of the fuel element 1006 of the cigarette lies in a plane that is virtually perpendicular to the longitudinal axis 1040 of the cigarette and a portion 1034 of the front face 1024 of the fuel element 1006 lies in a plane that is not perpendicular to the longitudinal axis of the cigarette. The angled front face 1034 of the cigarette is configured nominally in a plane at a position at least about 30°, and often at least about 40° relative to the longitudinal axis of that cigarette; and up to about 70°, and often up to about 60° relative to the longitudinal axis of the cigarette. For example, a portion 1034 of the front face of the fuel element lies along a front plane that nominally is positioned at an angle of about 40° to about 50° relative to the longitudinal axis of the cigarette.

Alternatively, the upstream face 1024 may have a multi-planar or multi-faceted configuration such that, for example, for a generally cylindrical cigarette rod having a circumference of about 22 mm to about 25 mm, one extreme tip 1042 of the wrapping material 1016 extends at least about 3 mm, often at least about 5 mm beyond the opposite extreme tip 1044 of that wrapping material on the opposite side (i.e., spaced 180°) of the front face of that tobacco rod. Preferably, the longer extreme tip 1042 of the wrapping material extends up to about 15 mm, often up to about 10 mm beyond the shorter extreme tip 1044 of that wrapping material on the opposite side of the front face of that cigarette rod. As such, for a cylindrical cigarette rod having a generally circular cross-sectional shape, the exposed end, or the lighting face, of that cigarette rod (and in particular, the lighting face of the fuel element) appears to have a shape that, when viewed perpendicularly to the front face portions 1036 and 1034, is partially generally circular in nature and partially generally elliptical in nature, respectively.

Figure 13:
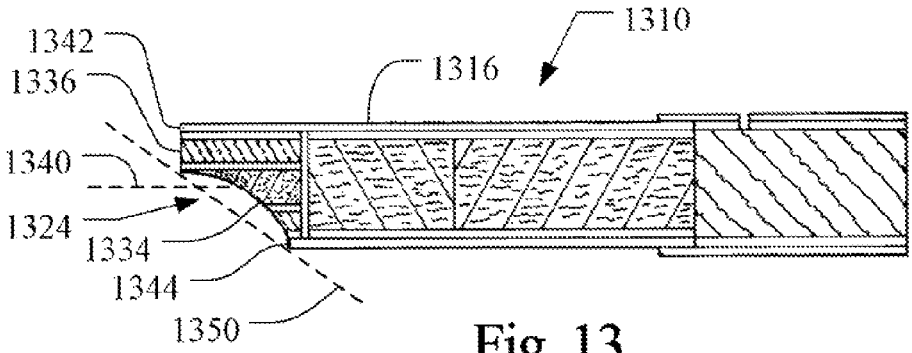

Referring to FIG. 13, there is shown a cigarette 1310 that is similar in many regards to the cigarette 1210 shown in FIG. 12. However, the angled face, rather than forming an essentially flat plane, is somewhat curved in nature. As shown in FIG. 13, a portion 1334 of front face 1324 of the cigarette rod is curved in towards the rod in a fashion that can be characterized as somewhat concave in nature. However, for an embodiment not shown, that concave portion of the front face of the cigarette rod can alternatively be curved outwards from the rod in a fashion that can be characterized as somewhat convex in nature. Most preferably, the exposed area of the front face portion 1336 of the cigarette that forms a plane generally perpendicular to the longitudinal axis 1340 of the cigarette is less than the exposed area of the front face portion 1334 that lies nominally along a plane 1350 that is not perpendicular (or is angled) relative to the longitudinal axis of the cigarette. The angled front face of the cigarette is configured nominally at a position at least about 30°, and often at least about 40° relative to the longitudinal axis 1340 of that cigarette; and up to about 70°, and often up to about 60° relative to the longitudinal axis of the cigarette. For example, the front face of the cigarette rod lies nominally along a front plane 1350 that is positioned at an angle of about 40° to about 50° relative to the longitudinal axis 1340 of the cigarette.

Alternatively, the upstream face 1324 may have a multi-surfaced configuration lying nominally along multiple different planes such that, for example, for a generally cylindrical cigarette rod having a circumference of about 22 mm to about 25 mm, one extreme tip 1342 of the wrapping material extends at least about 3 mm, often at least about 5 mm, beyond the opposite extreme tip 1344 of that wrapping material 1316 on the opposite side (i.e., spaced 180°) of the front face 1324 of that rod. Preferably the extreme tip 1342 of the wrapping material extends up to about 15 mm, often up to about 10 mm, beyond the opposite extreme tip 1344 of that wrapping material on the opposite side of the front face 1324 of that rod. As such, for a cylindrical cigarette rod having a generally circular cross-sectional shape, the exposed end, or the lighting face, of that cigarette rod (and in particular, the lighting face of the fuel element) appears to have a shape that, when viewed perpendicularly to the front face portions 1334 and 1336, is partially generally elliptical in nature and partially generally circular in nature, respectively.

Figure 14:
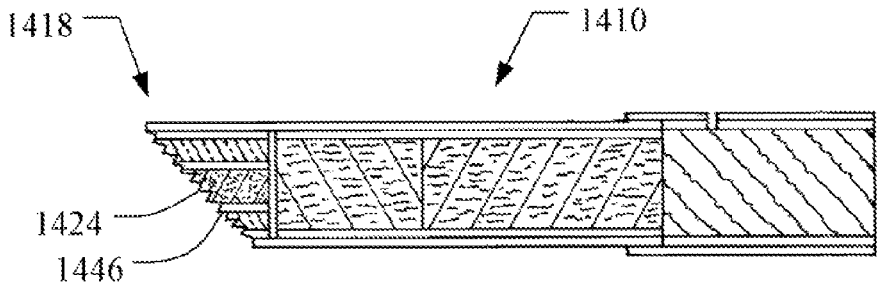

Referring to FIG. 14, there is shown a cigarette 1410 that is similar in many regards to the cigarette 810 shown in FIG. 8. However, for the embodiment of FIG. 14, the front face 1424 can be configured so as to possess a somewhat rough, jagged or serrated appearance, as opposed to a relatively flat form and appearance. For example, the edge 1446 of the extreme lighting end 1418 of the wrapping material can have, rather than a smooth or straight cut appearance, an appearance resembling that of a saw-toothed blade, a square wave, a scalloped-type or wavy-type of appearance, a shredded-type of appearance, or other type of roughened or serrated type of appearance. If desired, the various embodiments described with reference to FIGS. 10 through 13 also can be configured so as to possess a somewhat rough or serrated type of appearance at the extreme lighting end of particular interest for such an embodiment are cigarettes possessing fuel elements that can possess outwardly facing extreme lighting end surfaces that are rough or textured in nature, rather than smooth.

Figure 15:
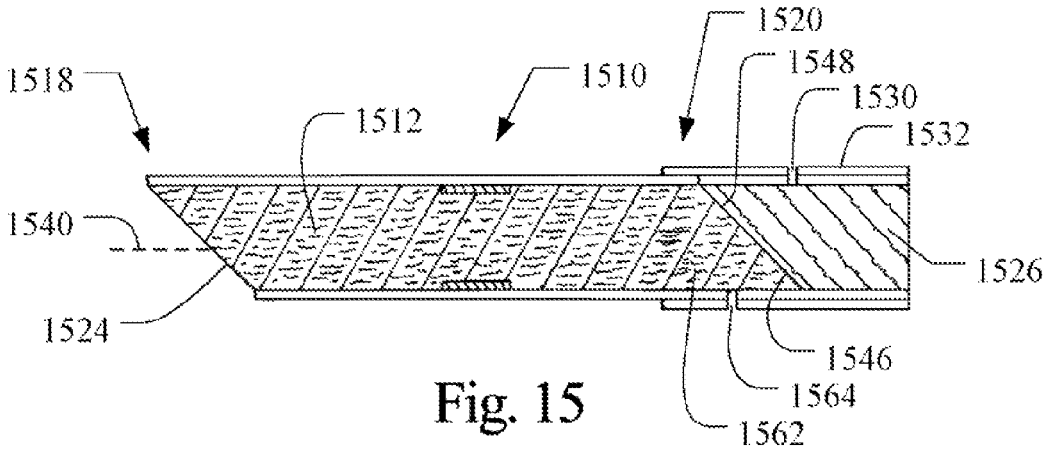

Yet another type of alternate embodiment of a cigarette of the present invention incorporates a cigarette rod possessing an angled lighting end, such as the type set forth previously with reference to FIGS. 1 through 7. Referring now to FIG. 15, the mouth end 1520 opposite the lighting end 1518 of the tobacco rod 1512 of a cigarette 1510 also can be configured so as to possess an angled end face 1546 (i.e., rather than an end face that is essentially perpendicular to the longitudinal axis of the cigarette). Preferably, both of the angled end faces 1524 and 1546 are positioned at essentially identical angles relative to the longitudinal axis 1540 of the cigarette (e.g., each of the two essentially flat faces is angled at about 45° relative to the longitudinal axis of that cigarette). For such an embodiment, it is preferable that the filter element 1526 have an angled front face 1548 that cooperates with the mouth end face 1546 of the tobacco rod (e.g., the front face of the filter element is essentially parallel to, and is in an essentially abutting relationship with respect to, the back face of the tobacco rod). Tipping material 1532 circumscribing the filter element 1526 and an adjacent region 1562 of the tobacco rod 1512 is employed to attach the tobacco rod to the filter element.

For such an embodiment as depicted in FIG. 15, a plurality of tobacco rods, each being similarly angled at both ends, can be manufactured using conventional types of automated cigarette rod manufacturing equipment (e.g., using cutting knives or rotary cutting wheels that are adapted, such as by being positioned at desired angles, to slice a continuous tobacco rod into tobacco rod segments of the desired lengths, and having front and back end faces that are angled and not perpendicular to their respective longitudinal axes). Preferably, the tobacco rod may have different densities along its length such that it is dense ended or packed more densely along locations corresponding to where the angle cut is to be made. Equipment and methods for creating regions of dense tobacco packing in tobacco rods are described in U.S. Pat. No. 6,708,695 to Fagg et al., which is incorporated herein by reference. For example, the dense packing of the tobacco is created at the rod forming garniture using a pocketed wheel, and then the cutting blades are synchronized to cut the continuous tobacco rod at the region of higher tobacco loading density. Each cut tobacco rod then can be attached to a filter element. For example, a so-called "two-up" filter element may be made with each end sliced at a desired angle (e.g., by being manufactured in a traditional type of manner, and using cutting knives or rotary cutting wheels that are adapted to slice a continuous filter rod into two-up segments, and having front and back faces that are angled and not perpendicular to the longitudinal axis of the that filter segment). Suitable modifications to conventional cigarette tipping machines can be made to align the abutting angled faces of the tobacco rod and filter segment. A tobacco rod is aligned at each end of the "two-up" filter segment, and the three segments are tipped to provide a "two-up" cigarette. Then, that "two-up" cigarette is sliced in half, preferably essentially perpendicular to the longitudinal axis of that cigarette, or at any other desired angle, to provide two finished cigarettes. As depicted in FIG. 15, air holes 1530 may be perforated around the filter element, as in conventional cigarettes. Instead of locating air holes 1530 completely around the filter element, the air holes 1564 may be perforated in a ring around the juncture of the angled faces 1546 and 1548 of the tobacco rod 1512 and the filter element 1526, respectively, such that some of the air holes in the ring are in direct communication with the tobacco filler material and other air holes in the ring are in communication with the filter element.

In use, cigarettes of the type described with reference to FIGS. 8 through 14, can be used in the following manner. Typically, the smoker lights the lighting end of the cigarette using a match or flame-type cigarette lighter, for example, using the techniques used to light cigarettes commercially marketed under the trade name "Eclipse" by R. J. Reynolds Tobacco Company. Alternatively, the cigarettes can be lighted using an electric resistance element type of heating device, such as an automobile cigarette lighter. If desired, the cigarette can be positioned relative to the flame of match or cigarette lighter so that the exposed lighting end segment of the cigarette rod faces the flame. Alternatively, if desired, the cigarette can be positioned relative to the flame of match or cigarette lighter so that the exposed lighting end segment of the cigarette rod does not face the flame, but rather, the wrapping material of the cigarette rod near the lighting end of the cigarette faces the flame. If desired, the exposed lighting end segment of the cigarette can be positioned during lighting to face downwards, upwards, or to one side; and in each such situation, the tip of the flame of the match or cigarette lighter can be positioned slightly below the extreme lighting end. After being lit, the cigarette can be smoked in an essentially normal fashion.

Representative types of tobacco rods can manufactured using a cigarette making machine, such as a conventional automated cigarette rod making machine. Exemplary cigarette rod making machines are of the type commercially available from Molins PLC or Hauni-Werke Korber & Co. KG. For example, cigarette rod making machines of the type known as MkX (commercially available from Molins PLC) or PROTOS (commercially available from Hauni-Werke Korber & Co. KG) can be employed. A description of a PROTOS cigarette making machine is provided in U.S. Pat. No. 4,474,190 to Brand, at col. 5, line 48 through col. 8, line 3, which is incorporated herein by reference. Types of equipment suitable for the manufacture of cigarettes also are set forth in U.S. Pat. No. 4,781,203 to La Hue; U.S. Pat. No. 4,844,100 to Holznagel; U.S. Pat. No. 5,156,169 to Holmes et al.; U.S. Pat. No. 5,191,906 to Myracle, Jr. et al.; U.S. Pat. No. 6,647,870 to Blau et al.; U.S. Pat. No. 6,848,449 to Kitao et al.; and U.S. Pat. No. 6,904,917 to Kitao et al.; and U.S. Patent Application Publication Nos. 2003/0145866 to Hartman; 2004/0129281 to Hancock et al.; 2005/0039764 to Barnes et al.; and 2005/0076929 to Fitzgerald et al.; each of which is incorporated herein by reference.

The components and operation of conventional automated cigarette making machines will be readily apparent to those skilled in the art of cigarette making machinery design and operation. For example, descriptions of the components and operation of several types of chimneys, tobacco filler supply equipment, suction conveyor systems and garniture systems are set forth in U.S. Pat. No. 3,288,147 to Molins et al.; U.S. Pat. No. 3,915,176 to Heitmann et al; U.S. Pat. No. 4,291,713 to Frank; U.S. Pat. No. 4,574,816 to Rudszinat; U.S. Pat. No. 4,736,754 to Heitmann et al. U.S. Pat. No. 4,878,506 to Pinck et al.; U.S. Pat. No. 5,060,665 to Heitmann; U.S. Pat. No. 5,012,823 to Keritsis et al. and U.S. Pat. No. 6,360,751 to Fagg et al.; and U.S. Patent Application Publication No. 2003/0136419 to Muller; each of which is incorporated herein by reference. The automated cigarette making machines of the type set forth herein provide a formed continuous cigarette rod or smokable rod that can be subdivided into formed smokable rods of desired lengths.

Cigarette rods manufactured in a variety of manners using known types of automated cigarette making techniques can be provided with lighting ends that are not entirely perpendicular to the longitudinal axis thereof. For example, conventional cigarettes (e.g., filter cigarettes) can be manufactured, then aligned in a desired position, and a knife, razor blade, circular cutting wheel, or the like, can be used to slice the lighting end of each cigarette at an angle to provide cigarettes having angled lighting ends. In such a manner, cigarettes can be cut to the desired configuration individually or as part of a plurality or collection of cigarettes. In one embodiment, a layer or several layers of finished cigarettes can be aligned on a moving conveyor belt, or other suitable means, such that relevant portions of the lighting ends of those cigarettes extend from the belt within a cutting zone, and those cigarettes are aligned so as to be non-perpendicular to the axis of movement of the conveyor belt; such that a cutting wheel can be configured essentially perpendicular to the axis of movement of the conveyor belt so as to slice off the ends of the cigarette rods of those finished cigarettes, and hence provide a plurality of cigarettes each having angled ends or partially angled ends. Alternatively, cigarette rods can be manufactured and have ends that are cut in the desired manner (e.g., so as to have ends that are not entirely perpendicular to the longitudinal axis of each cigarette) using appropriately positioned rotating rod cutting wheels. Those rods then can be combined with filter elements using tipping materials, using traditional types of filter cigarette manufacturing techniques. Alternatively, so-called "two-up" cigarette rods can be cut or otherwise subdivided at an angle that is not perpendicular to the longitudinal axis of each "two-up" segment, so as to provide two cigarette rods that each have angled ends. Such a manner or method is particularly desirable for providing two cigarette rods that each have ends angled at 45° relative to the longitudinal axis of each segment. Those segments then can be combined with other components, such as filter elements.

Cigarettes also can be manufactured using the types of equipment and methods set forth in U.S. Patent Application Publication Nos. 2006/0272654 to Barnes et al., 2006/0272655 to Thomas et al., and 2007/0006888 to Hicks et al., which are each incorporated herein by reference. In such a regard, for example with reference to the devices shown at FIGS. 12 and 13 of these applications, formed cigarettes can be positioned in a cartridge or other device for aligning and positioning those cigarettes, and the cartridge or aligned device can be adapted so that those cigarettes are positioned at a desired angle with respect to a cutting device aligned in a normal position as depicted. Alternatively, the cutting device support may be positioned or tilted at a desired angle with respect to the cartridge having cigarettes aligned in a normal position as depicted. As a result, a circular cutting wheel, or other cutting device, can be used to trim the lighting ends of those cigarettes such that those cigarettes each have angled ends (i.e., ends that are not essentially entirely perpendicular to the longitudinally axis of each cigarette).

Cigarettes, and the components thereof, also can be of the type set forth in U.S. Patent Application Publication No. 2007/0215167 to Crooks et al. In such a regard, lighting end segments or cigarettes incorporating those lighting end segments can be cut, sliced or formed in the desired manner. Alternatively, so-called "two-up" lighting end segments can be cut or otherwise subdivided at an angle that is not perpendicular to the longitudinal axis of each "two-up" segment, so as to provide two lighting end segments that each have angled ends. Such a manner or method is particularly desirable for providing lighting end segments that each have ends angled at 45° relative to the longitudinal axis of each segment. Those segments so formed then can be combined with other components of those types of smoking articles. Alternatively, finished cigarettes can have their ends cut, sliced, or otherwise formed into the desired shape or configuration.

Various types of cigarette components, including tobacco types, tobacco blends, top dressing and casing materials, blend packing densities and types of paper wrapping materials for cigarette rods, can be employed. See, for example, the various representative types of cigarette components, as well as the various cigarette designs, formats, configurations and characteristics, that are set forth in Johnson, *Development of Cigarette Components to Meet Industry Needs,* 52$^{nd}$ T.S.R.C. (September 1998); U.S. Pat. No. 5,101,839 to Jakob et al; U.S. Pat. No. 5,159,944 to Arzonico et al.; U.S. Pat. No. 5,220,930 to Gentry and U.S. Pat. No. 6,779,530 to Kraker; U.S. Patent Application Publication Nos. 2005/0016556 to Ashcraft et al., 2005/0066986 to Nestor et al., and 2006/0272655 to Thomas et al; U.S. patent application Ser. No. 11/408,625, filed Apr. 21, 2006, to Oglesby and Ser. No. 11/696,416 to Marshall et al.; each of which is incorporated herein by reference. Most preferably, the entire smokable rod is composed of smokable material (e.g., tobacco cut filler) and a layer of circumscribing outer wrapping material.

Components for filter elements for filtered cigarettes typically are provided from filter rods that are produced using traditional types of rod-forming units, such as those available as KDF-2 and KDF-3E from Hauni-Werke Korber & Co. KG.

Typically, filter material, such as filter tow, is provided using a tow processing unit. An exemplary tow processing unit has been commercially available as E-60 supplied by Arjay Equipment Corp., Winston-Salem, N.C. Other exemplary tow processing units have been commercially available as AF-2, AF-3, and AF-4 from Hauni-Werke Korber & Co. KG. In addition, representative manners and methods for operating a filter material supply units and filter-making units are set forth in U.S. Pat. No. 4,281,671 to Byrne; U.S. Pat. No. 4,862,905 to Green, Jr. et al.; U.S. Pat. No. 5,060,664 to Siems et al; U.S. Pat. No. 5,387,285 to Rivers; and U.S. Pat. No. 7,074,170 to Lanier, Jr. et al. Other types of technologies for supplying filter materials to a filter rod-forming unit are set forth in U.S. Pat. No. 4,807,809 to Pryor et al and U.S. Pat. No. 5,025,814 to Raker; which are incorporated herein by reference.

The plug wrap can vary. See, for example, U.S. Pat. No. 4,174,719 to Martin. Typically, the plug wrap is a porous or non-porous paper material. Suitable plug wrap materials are commercially available. Exemplary plug wrap papers ranging in porosity from about 1,100 CORESTA units to about 26,000 CORESTA units are available from Schweitzer-Mauduit International as Porowrap 17-M1, 33-M1, 45-M1, 70-M9, 95-M9, 150-M4, 150-M9, 240M9S, 260-M4 and 260-M4T; and from Miquel-y-Costas as 22HP90 and 22HP150. Non-porous plug wrap materials typically exhibit porosities of less than about 40 CORESTA units, and often less than about 20 CORESTA units. Exemplary non-porous plug wrap papers are available from Olsany Facility (OP Paprina) of the Czech Republic as PW646; Wattenspapier of Austria as FY/33060; Miquel-y-Costas of Spain as 646; and Schweitzer-Mauduit International as MR650 and 180. Plug wrap paper can be coated, particularly on the surface that faces the filter material, with a layer of a film-forming material. Such a coating can be provided using a suitable polymeric film-forming agent (e.g., ethylcellulose, ethylcellulose mixed with calcium carbonate, nitrocellulose, nitrocellulose mixed with calcium carbonate, or a so-called lip release coating composition of the type commonly employed for cigarette manufacture). Alternatively, a plastic film (e.g., a polypropylene film) can be used as a plug wrap material. For example, non-porous polypropylene materials that are available as ZNA-20 and ZNA-25 from Treofan Germany GmbH & Co. KG can be employed as plug wrap materials.

Cigarette filter rods can be used to provide multi-segment filter rods. Such multi-segment filter rods then can be employed for the production of filtered cigarettes possessing multi-segment filter elements. An example of a two-segment filter element is a filter element possessing a first cylindrical segment incorporating activated charcoal particles dispersed within cellulose acetate tow (e.g., a "dalmation" type of filter segment) at one end, and a second cylindrical segment that is produced from a filter rod produced essentially of flavored, plasticized cellulose acetate tow filter material at the other end. The production of multi-segment filter rods can be carried out using the types of rod-forming units that traditionally have been employed to provide multi-segment cigarette filter components. Multi-segment cigarette filter rods can be manufactured using a cigarette filter rod making device available under the brand name Mulfi from Hauni-Werke Korber & Co. KG of Hamburg, Germany. Representative types of filter designs and components, including representative types of segmented cigarette filters, are set forth in U.S. Pat. No. 4,920,990 to Lawrence et al; U.S. Pat. No. 5,012,829 to Thesing et al.; U.S. Pat. No. 5,025,814 to Raker; U.S. Pat. No. 5,074,320 to Jones et al.; U.S. Pat. No. 5,105,838 to White et al; U.S. Pat. No. 5,271,419 to Arzonico et al; U.S. Pat. No. 5,360,023 to Blakley et al; U.S. Pat. No. 5,396,909 to Gentry et al; and U.S. Pat. No. 5,718,250 to Banerjee et al; U.S. Patent Application Publication Nos. 2002/0166563 to Jupe et al., 2004/0261807 to Dube et al.; 2005/0066981 to Crooks et al. and 2007/0056600 to Coleman III, et al.; and PCT Publication Nos. WO 03/009711 to Kim and. WO 03/047836 to Xue et al.; which are incorporated herein by reference.

The length of the filter element of each cigarette can vary. Typically, the overall length of a filter element is about 20 mm to about 40 mm, and often about 25 mm to about 35 mm. For a typical dual-segment filter element, the downstream or mouth end filter segment often has a length of about 10 mm to about 20 mm; and the upstream or tobacco rod end filter segment often has a length of about 10 mm to about 20 mm.

Filter elements, or filter segment components of combination filters, typically are provided from filter rods that are manufactured using traditional types of cigarette filter rod making techniques. For example, so-called "six-up" filter rods, "four-up" filter rods and "two-up" filter rods that are of the general format and configuration conventionally used for the manufacture of filtered cigarettes can be handled using conventional-type or suitably modified cigarette rod handling devices, such as tipping devices available as Lab MAX, MAX, MAX S or MAX 80 from Hauni-Werke Korber & Co. KG. See, for example, the types of devices set forth in U.S. Pat. No. 3,308,600 to Erdmann et al.; U.S. Pat. No. 4,281,670 to Heitmann et al.; U.S. Pat. No. 4,280,187 to Reuland et al.; U.S. Pat. No. 4,850,301 to Greene, Jr. et al.; and U.S. Pat. No. 6,229,115 to Vos et al.; and U.S. Patent Application Publication Nos. 2005/0103355 to Holmes, 2005/1094014 to Read, Jr., and 2006/0169295 to Draghetti, each of which is incorporated herein by reference. The operation of those types of devices will be readily apparent to those skilled in the art of automated cigarette manufacture.

The tipping material can vary. Typical tipping materials are papers exhibiting relatively high opacities. Representative tipping materials have TAPPI opacities of greater than about 81 percent, often in the range of about 84 percent to about 90 percent, and sometimes greater than about 90 percent. Typical tipping materials are printed with inks, typically nitrocellulose based, which can provide for a wide variety of appearances and "lip release" properties. Representative tipping papers materials have basis weights ranging from about 25 $m/m^2$ to about 60 $g/m^2$, often about 30 $g/m^2$ to about 40 $g/m^2$. Representative tipping papers are available as Tervakoski Reference Nos. 3121, 3124, TK 652, TK674, TK675, A360 and A362; and Schweitzer-Mauduit International Reference Nos. GSR270 and GSR265M2. See also, for example, the types of tipping materials, the methods for combining cigarette components using tipping materials, and techniques for wrapping various portions of cigarettes using tipping materials, that are set forth in U.S. Patent Application Publication No. 2007/0215167 to Crooks etaal The following examples are provided in order to further illustrate the present invention, but should not be construed as limiting the scope thereof.

EXAMPLE 1

Filter cigarettes that are manufactured using automated cigarette making machine technology are provided. Those cigarettes incorporate tobacco rods composed of an "American blend" of tobaccos in cut filler form. The tobacco cut filler is cased and flavored. The tobacco rods possess an outer layer of paper wrapping material that circumscribes the tobacco cut filler such that each end of the cylindrical rods so formed is open to expose the tobacco within that rod. Each tobacco rod has a length of about 57 mm and a circumference of about 25 mm. Each cigarette possesses a filter element composed of cellulose acetate plasticized using triacetin, and the length of each filter element is about 27 mm. The tipping paper that connects each filter element to each tobacco rod circumscribes the length of each filter element and about 4 mm of the adjacent region of the tobacco rod. A circumscribing ring of laser perforations through the tipping material and plug wrap of each cigarette provides cigarettes that are air diluted. A razor blade or scissors is used to cut a portion of the tobacco rod from certain cigarettes at the extreme lighting ends of those cigarettes. The cigarettes have the general appearance of the cigarette described previously with reference to FIGS. 1 and 2. The angled straight cut at the lighting end of each tobacco rod is at about 45° relative to the longitudinal axis of each cigarette. For those cigarettes having angled lighting ends, no further treatment of those cigarette ends is provided (i.e., no chemical additives are added to the exposed end of the cigarette or to the wrapping material of the tobacco rod in the lighting region of the cigarette). However, if desired, the cigarettes may be held upright, filter end down, and tapped lightly several times on a table or counter top, in order to provide for some compaction of the tobacco cut filler within the tobacco rod; or tobacco cut filler at the lighting end of the cigarette can be pressed lightly into the tobacco rod, in a type of "dense ending" fashion.

Such cigarettes are provided and comparison cigarettes (i.e., a comparable cigarette not having a lighting end segment cut therefrom, and hence having a lighting end that is essentially perpendicular to the longitudinal axis of the cigarette rather than angled end) each are smoked under FTC smoking conditions. The cigarettes are lit using an electrical resistance heating unit.

For the cigarette having the angled end, the lighting puff exhibits a "tar" yield of 0.49 mg, a nicotine yield of 0.035 mg, and a carbon monoxide yield of 0.32 mg. For the traditional cigarette not having the angled end, the lighting puff exhibits a "tar" yield of 0.97 mg, a nicotine yield of 0.065 mg, and a carbon monoxide yield of 1.33 mg.

For the cigarette having the angled end, the second puff exhibits a "tar" yield of 1.25 mg, a nicotine yield of 0.098 mg, and a carbon monoxide yield of 1.1 mg. For the traditional cigarette not having the angled end, the second puff exhibits a "tar" yield of 1.1 mg, a nicotine yield of 0.093 mg, and a carbon monoxide yield of 1.04 mg.

For the cigarette having the angled end, the third puff exhibits a "tar" yield of 1.43 mg, a nicotine yield of 0.118 mg, and a carbon monoxide yield of 1.19 mg. For the traditional cigarette not having the angled end, the third puff exhibits a "tar" yield of 1.28 mg, a nicotine yield of 0.110 mg, and a carbon monoxide yield of 1.12 mg.

For the cigarette having the angled end, the fourth puff exhibits a "tar" yield of 1.52 mg, a nicotine yield of 0.126 mg, and a carbon monoxide yield of 1.13 mg. For the traditional cigarette not having the angled end, the fourth puff exhibits a "tar" yield of 1.46 mg, a nicotine yield of 0.112 mg, and a carbon monoxide yield of 1.18 mg.

The results demonstrate that the smoke yield and composition (i.e., smoke chemistry) of an early puff (e.g., the lighting puff) of a cigarette can be altered relative to a cigarette of traditional configuration by altering the configuration of the lighting end of a cigarette.

EXAMPLE 2

Cigarettes marketed under the trade name "Eclipse" by R. J. Reynolds Tobacco Company are obtained. A razor blade is used to slice away a portion of the lighting end of each cigarette, and as such, cigarettes of the type described previously with reference to FIGS. 8 and 9 are provided. The angled straight cut of each lighting end is at about 45° relative to the longitudinal axis of each cigarette, and as such, the entire lighting end of the carbonaceous fuel element is angled at about 45° relative to the longitudinal axis of each cigarette. For those cigarettes having angled lighting ends, no further treatment of those cigarette ends is provided (i.e., no chemical additives are added to the exposed end of the cigarette or to the wrapping material of the tobacco rod in the lighting region of the cigarette).

Such cigarettes are provided and comparison cigarettes (i.e., a comparable cigarette not having a lighting end segment cut therefrom, and hence having a lighting end that is essentially perpendicular to the longitudinal axis of the cigarette rather than angled end) each are smoked under FTC smoking conditions. The cigarettes are lit using an electrical resistance heating unit.

For the cigarette having the angled end, the lighting puff exhibits a "tar" yield that is negligible, a nicotine yield that is negligible, and a carbon monoxide yield of 0.42 mg. For the traditional cigarette not having the angled end, the lighting puff exhibits a "tar" yield that is negligible, a nicotine yield that is negligible, and a carbon monoxide yield of 1.10 mg.

For the cigarette having the angled end, the second puff exhibits a "tar" yield of 0.49 mg, a nicotine yield of 0.013 mg, and a carbon monoxide yield of 0.27 mg. For the traditional cigarette not having the angled end, the second puff exhibits a "tar" yield of 0.67 mg, a nicotine yield of 0.018 mg, and a carbon monoxide yield of 0.45 mg.

For the cigarette having the angled end, the third puff exhibits a "tar" yield of 0.66 mg, a nicotine yield of 0.027 mg, and a carbon monoxide yield of 0.33 mg. For the traditional cigarette not having the angled end, the third puff exhibits a "tar" yield of 0.80 mg, a nicotine yield of 0.034 mg, and a carbon monoxide yield of 0.47 mg.

For the cigarette having the angled end, the fourth puff exhibits a "tar" yield of 0.66 mg, a nicotine yield of 0.030 mg, and a carbon monoxide yield of 0.32 mg. For the traditional cigarette not having the angled end, the fourth puff exhibits a "tar" yield of 0.83 mg, a nicotine yield of 0.036 mg, and a carbon monoxide yield of 0.46 mg.

For the cigarette having the angled end, the fifth puff exhibits a "tar" yield of 0.63 mg, a nicotine yield of 0.026 mg, and a carbon monoxide yield of 0.28 mg. For the traditional cigarette not having the angled end, the fifth puff exhibits a "tar" yield of 0.85 mg, a nicotine yield of 0.033 mg, and a carbon monoxide yield of 0.47 mg.

For the cigarette having the angled end, the sixth puff exhibits a "tar" yield of 0.42 mg, a nicotine yield of 0.017 mg, and a carbon monoxide yield of 0.21 mg. For the traditional cigarette not having the angled end, the sixth puff exhibits a "tar" yield of 0.72 mg, a nicotine yield of 0.027 mg, and a carbon monoxide yield of 0.40 mg.

For the cigarette having the angled end, the seventh puff exhibits a "tar" yield of 0.17 mg, a nicotine yield of 0.009 mg, and a carbon monoxide yield of 0.14 mg. For the traditional cigarette not having the angled end, the seventh puff exhibits a "tar" yield of 0.43 mg, a nicotine yield of 0.018 mg, and a carbon monoxide yield of 0.29 mg.

For the cigarette having the angled end, the eighth puff exhibits a "tar" yield of 0.06 mg, a nicotine yield of 0.004 mg, and a carbon monoxide yield of 0.095 mg. For the traditional cigarette not having the angled end, the eighth puff exhibits a "tar" yield of 0.23 mg, a nicotine yield of 0.011 mg, and a carbon monoxide yield of 0.19 mg.

The results illustrate that the smoke yield and composition (i.e., smoke chemistry) of the lighting puff and early puffs of a cigarette can be altered relative to a cigarette of traditional configuration by altering the configuration of the lighting end of a cigarette. The smoke constituents identified in the examples are tar, nicotine and carbon monoxide. Substantial reduction of all three smoke constituents is obtained at differing puffs. No chemical treatment of the lighting end of the smoking article is required to obtain smoke constituent reduction. No chemical or mechanical attenuator is required to be added into the cigarette rod to obtain smoke constituent reduction, however, chemical treatment or physical attenuator components that supplement smoke constituent reduction may be used. Accordingly, it is preferred to have the lighting end of the smoking article configured to have an exposed end surface in fashioned in manners as described above such that the surface area of the exposed end surface is sufficiently greater than the cross-sectional area of the smoking article to reduce the quantity of one or more smoke constituents, such as tar, nicotine or carbon monoxide, by at least 20% averaged over one or more puffs, preferably including the initial puff, and more preferably over a sequence of at least four sequential puffs, of the smoking article compared to a smoking article of the same composition have an exposed end surface in a plane perpendicular to the longitudinal axis of the smoking article. Preferably, the reduction of one or more smoke constituents is at least 25%, more preferably at least 30%.

Many modifications and other aspects of the invention will come to mind to one skilled in the art to which this invention pertains having the benefit of the teachings presented in the foregoing description; and it will be apparent to those skilled in the art that variations and modifications of the present invention can be made without departing from the scope or spirit of the invention. Therefore, it is to be understood that the invention is not to be limited to the specific aspects disclosed and that modifications and other aspects are intended to be included within the scope of the appended claims. Although specific terms are employed herein, they are used in a generic and descriptive sense only and not for purposes of limitation.

We claim:

1. A smoking article embodied as a cigarette, which comprises an elongated cylindrical shape with a longitudinal axis, a lighting end and a mouth end, the lighting end configured with a first exposed end surface of a rod of smokable material comprising a plane that is not perpendicular to the longitudinal axis of the smoking article, wherein the lighting end further comprises a second exposed end surface in a plane that is generally perpendicular to said longitudinal axis, and wherein the second exposed end surface is generally contiguous with the first end surface along a border region.

2. The smoking article of claim 1, wherein the first end surface plane is disposed at an angle between about 30 and about 60 degrees relative to said longitudinal axis.

3. The smoking article of claim 1 wherein the border region comprises a generally planar surface between the first exposed end surfaces and the second exposed end surface.

4. The smoking article of claim 1 wherein the border region comprises a generally curved surface transition between the first exposed end surfaces and the second exposed end surface.

5. The smoking article of claim 1, wherein the first exposed end surface has a portion of an elliptical shape.

6. The smoking article of claim 1, wherein the first exposed end surface has a side view profile comprising a portion of a parabolic shape.

7. The smoking article of claim 1, wherein the rod of smokable material comprises a rod of tobacco material wrapped in paper, and the end surface plane that is not perpendicular to the longitudinal axis of the smoking article comprises more than half of the surface area of the lighting end.

8. A smoking article having a longitudinal axis, and having a lighting end and a mouth end, the smoking article comprising:

a paper wrapping material that circumscribes a generally cylindrical aerosol-generating system that includes (i) a heat generation segment including a non-tobacco fuel element, with the wrapping material circumscribed thereabout, located near the lighting end, and (ii) an aerosol-generating region or segment located between the mouth end and the heat generation segment, and further comprising a lighting end configured with an exposed end surface of the heat generation segment configured in a plane that is not perpendicular to the longitudinal axis of the smoking article.

9. The smoking article of claim 8 wherein the end surface plane is disposed at an angle between about 30 and about 60 degrees relative to said longitudinal axis.

10. The smoking article of claim 8 wherein the lighting end further comprises a second exposed end surface in a plane that is generally perpendicular to said longitudinal axis, and wherein the second exposed end surface is generally contiguous with the first end surface along a border region.

11. The smoking article of claim 10 wherein the border region comprises a generally planar surface between the first exposed end surfaces and the second exposed end surface.

12. The smoking article of claim 10 wherein the border region comprises a generally curved surface transition between the first exposed end surfaces and the second exposed end surface.

13. The smoking article of claim 8 wherein the first exposed end surface has an elliptical shape.

14. The smoking article of claim 8 wherein the first exposed end surface has a portion of an elliptical shape.

15. The smoking article of claim 8 wherein the first exposed end surface has a side view profile comprising a portion of a parabolic curve shape.

16. The smoking article of claim 8 wherein the end surface plane that is not perpendicular to the longitudinal axis of the smoking article comprises more than half of the surface area of the lighting end.

17. The smoking article of claim 16 wherein the first exposed end surface plane comprises a plane connecting the longest extreme tip of the smoking article at the lighting end and the shortest extreme tip of the smoking article at the lighting end.

18. The smoking article of claim 17 wherein the longest extreme tip extends between 5 mm and 15 mm beyond the shortest extreme tip.

19. The smoking article of claim 8 wherein the fuel element includes an exposed end surface, and wherein the exposed end surface of the fuel element forms the lighting end and comprises a plane that is not perpendicular to the longitudinal axis of the smoking article.

* * * * *